United States Patent [19]

Meyers

[11] Patent Number: 4,627,177

[45] Date of Patent: Dec. 9, 1986

[54] INSOLE STRUCTURE

[76] Inventor: Stuart R. Meyers, 2910 Wallace Ave., Bronx, N.Y. 10467

[21] Appl. No.: 761,662

[22] Filed: Aug. 1, 1985

Related U.S. Application Data

[63] Continuation of Ser. No. 626,424, Jul. 2, 1984, abandoned, which is a continuation of Ser. No. 438,389, Nov. 1, 1982, abandoned.

[51] Int. Cl.[4] ..... A43B 13/38

[52] U.S. Cl. ..... 36/43; 36/91; 128/595

[58] Field of Search ..... 36/43, 44, 31, 32 R, 36/88, 93, 91; 128/595, 586, 614

[56] References Cited

U.S. PATENT DOCUMENTS

| | | | |
|---|---|---|---|
| 4,338,734 | 7/1982 | Schwartz | 36/44 |
| 4,364,188 | 12/1982 | Turner et al. | 36/31 |
| 4,364,189 | 12/1982 | Bates | 36/31 |

FOREIGN PATENT DOCUMENTS

| | | | |
|---|---|---|---|
| 129919 | 10/1932 | Austria | 128/595 |
| 2709546 | 9/1978 | Fed. Rep. of Germany | 36/44 |
| 2751146 | 5/1979 | Fed. Rep. of Germany | 36/31 |
| 2806481 | 8/1979 | Fed. Rep. of Germany | 36/31 |

*Primary Examiner*—James Kee Chi

*Attorney, Agent, or Firm*—Davis Hoxie Faithfull & Hapgood

[57] ABSTRACT

A footwear insole member comprising a first portion the area of the upper surface of which approximately underlies the area of the longitudinal arch and a second portion the area of the upper surface of which underlies at least about 10% of the medial area of the heel and from 0 to about 50% of the lateral area of the heel, the border of the area of the upper surface of said second portion including about 10% to about 65% of the outer edge of the heel area, said first and second portions being less compressible than the remaining portions of said member.

7 Claims, 4 Drawing Figures

INSOLE STRUCTURE

This is a continuation of Ser. No. 626,424, filed on July 2, 1984, now abandoned, which is a continuation of Ser. No. 438,389, filed on Nov. 1, 1982, now abandoned.

This application is a continuation-in-part of my application Ser. No. 196,020 filed Oct. 10, 1980 which is in turn a division of my application Ser. No. 970,010 filed Dec. 18, 1978 and now U.S. Pat. No. 4,297,797 dated Nov. 3, 1981, the disclosures of which prior applications and patent are incorporated herein by reference thereto.

The "Background and Description of the Prior Art" in lines 9–55 of column 1 of my said patent are applicable to the present application. Reference is also made to the "Reference Cited" in my said patent. None of the references referred to in my said patent teach the invention disclosed and claimed in said patent or more particularly in this application.

According to the invention described in my said patent, a footwear insole member is provided comprising a medial portion less compressible then the lateral and metatarsal portions whereby the weight of the foot undergoing compression in the lateral and metatarsal portions dynamically forms a medial arch. The member is mainly described as formed of a multiplicity of compressible fluid filled chambers, the variations in compressibility between the medial portion and the remaining portions being achieved by suitable adjustment or selection of the sizes and/or wall thickness and the like of the chambers in the respective portions.

One object of this application and invention is to further elaborate on the functions and advantages of the device disclosed in my U.S. Pat. No. 4,297,797.

Another object of this invention is to provide an insole member which is further improved relative to the insole member disclosed and/or claimed in my said patent.

Still another object of this invention is the provision of an insole member which is more economical and/or simple to make and/or lighter in weight and/or more insulative relative to the insole member of my said patent.

Yet a further object of this invention is the provision of an insole member providing further improvements with respect to comfort, prevention of excessive medial roll of the heel, and/or better or more efficient biomechanical functions relative to the insole member of my said patent.

The attainment of one or more of these and other objects and advantages is made possible by this invention which comprises a footwear insole member comprising a first portion the area of the upper surface of which approximately underlies the area of the longitudinal arch and a second portion the area of the upper surface of which underlies at least about 10% of the medial area of the heel and from 0 to about 50% of the lateral area of the heel, the border of the area of the upper surface of said second portion including about 10% to about 65% of the outer edge of the heel area, said first and second portions being less compressible than the remaining portions of said member.

The means of such attainment is explained in the following description and the accompanying drawings in which.

In the several figures of the drawing, like reference characters indicate like parts of said insole member.

Figure 1:
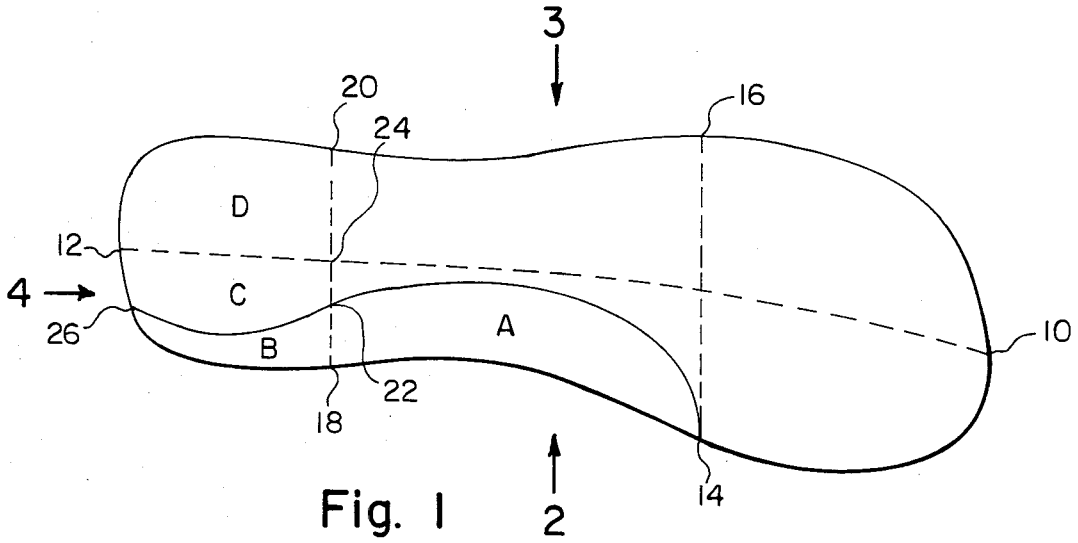
FIG. 1 is a plan view from above of a preferred embodiment of a left foot insole member of this invention.

Referring to the upper surface area shown in FIG. 1, and in relation to corresponding parts of the (lower surface of the) foot, the broken line joining 10 and 12 generally divides the lateral area of the insole member (completed by the curvilinear line through 16 and 20) from the medial area of the insole member (completed by the curvilinear line through 14 and 18). The area of the metatarsal head and toe portions is generally bound by the lines joining 14, 10 and 16 back to 14. The area A of the longitudinal arch is generally bound by curvilinear lines 18-14 and 14-22 and broken lines 22-18. The medial area B and C of the heel is generally bound by curvilinear line 18-12 and broken lines 12-24 and 24-18. The lateral area D of the heel is generally bound by curvilinear line 20-12 and broken lines 12-24 and 24-20. The outer edge of the heel area is generally defined by the curvilinear line joining 20, 12 and 18.

According to the invention, the aforesaid area A of the longitudinal arch (first portion) and the area B bound by curvilinear lines 18-26 and 26-22 and broken line 22-12 (second portion) generally define the upper surfaces of the portions of the insole member less compressible (e.g. more dense) than the remaining portions of said member; the area B of said second portion constitutes at least about 10% of the aforesaid medial area B and C of the heel and from 0 to about 50% of the aforesaid lateral area D of the heel; and the outer border of the area B of said second portion includes about 10% to about 65% (curvilinear line 26-18) of the aforesaid outer edge of the heel area B, C and D. Curvilinear line joining 26, 22 and 14, shown as being approximately S-shaped, marks the horizontal line of separation between the less compressible portions under areas A and B and the remaining portions of the insole member.

Figure 2:
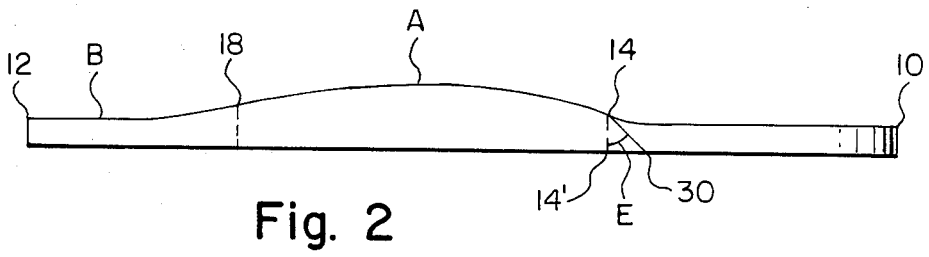
FIG. 2 is a medial side view of the insole member of FIG. 1 from the direction of arrow 2.

FIG. 2 from the medial side shows, according to a preferred embodiment, the upwardly contoured edge of the longitudinal arch, area A. Also according to a preferred embodiment, the less compressible portion under area A is shown as undercutting the more compressible portion of the metatarsal area along line 14-30 at a downwardly sloping angle E (measured from the vertical line 14—14') to form a wedge indicated by the lines joining 14, 30, and 14'. Angle E shown at 45°, preferably may range up to about 85°, more preferably from about 20° to about 65°.

Figure 3:
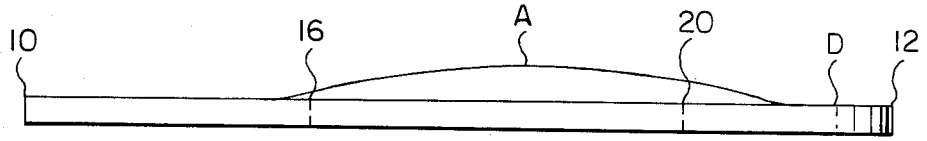
FIG. 3 is a lateral side view of the insole member of FIG. 1 from the direction of arrow 3.

FIG. 3 from the lateral side shows the upwardly sloping contour of the longitudinal arch under area A.

Figure 4:
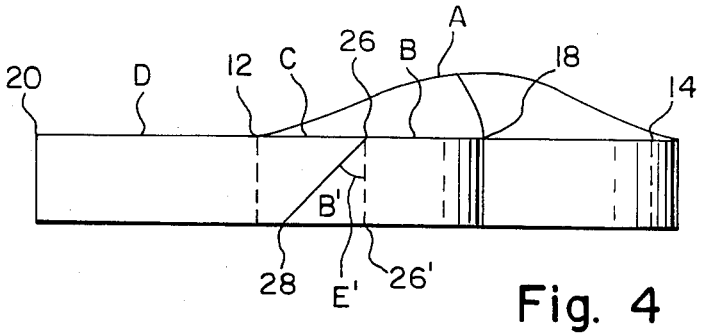
FIG. 4 is an enlarged end view of the insole member of FIG. 1 from the direction of arrow 4.

FIG. 4 from the heel end also shows the upwardly sloping contour of the longitudinal arch area A. The less compressible portion under area B is shown as undercutting the more compressible portion under heel area C in the form of a wedge B' defined by the lines joining 26, 28 and 26' forming a downwardly sloping angle E', (measured from the vertical line 26—26). Angle E', shown as about 45°, may preferably range up to 85°, more preferably from about 20° to about 65°, and may be the same as or different from angle E (FIG. 2), i.e. the angle of the undercutting wedge may vary along the S-shaped line 26-22-14. Alternatively, the portions under areas A and B may have no undercutting wedge borders, i.e. angles E and E' would be 0°.

It will be understood that within the scope of my invention variations within the several aforesaid ranges of angles, area values, sizes and positions, etc., and modifications of the preferred embodiments shown, for illustrative pruposes only, in the drawing will become obvious, and in some instances advisable or even necessary, to those skilled in the art. By way of example, and depending upon such factors as the type, foot size, foot shape, foot sensitivity, age, etc. of the user, the type of footwear, the activity contemplated, etc., points 16, 20, 26, 18 and 14 may be shifted as deemed advisable in either direction along the periphery of the insole member, the shape and location of the line 26-22-14 may be changed or even rendered non S-shaped, e.g., its intersection at 22 may be shifted in either direction along line 18-20, it may curve into the lateral area, and/or its terminus at 14 may not coincide with the line 16-14 demarking the inner edge of the metatarsal area, the shape and size of the insole member may be varied, etc.

Preferably but not necessarily the lower or bottom surface of the insole member is essentially planar (it may be transversely or longitudinal grooved or ridged) and its upper surface is contoured in approximate conformance with the bottom surface of the foot, and the thickness of the insole member may vary from about ⅛" to about 1.5", preferably generally decreasing from heel to toe and from medial arch to lateral side with suitable cupping in such areas as the heel, lateral side and ball of the foot. The insole member of this invention may be provided for insertion into existing footwear or it may be made part of the original construction of the footwear.

An essential feature of this invention involves the use of more or less compressible or resilient material. This material may be natural or synthetic and solid (non-cellular) or cellular (e.g. foam, sponge, microcellular, macrocellular, honeycombed). The degree of compressibility of these materials may be controlled, adjusted and predetermined in known matter, e.g. density, cell size, cell wall thickness, degree of polymerization and/or cross-linking, etc. Generally elastomeric, examples of such material include latex, natural rubber, butyl rubber, BSR (butadiene/styrene rubber), ABS rubber (acrylonitrile/butadiene/styrene terpolymer), polyurethane, other plastics, copolymers and interpolymers thereof, etc. A microcellular foam structure is preferred which may be closed celled or open-celled (permitting transfer of fluid between cells with shock-absorbing effect under weight-bearing conditions. The cellular material may contain any suitable fluid in its cells, e.g. air or any other gas or water or any other suitable liquid. A polyurethane microcellular foam material is preferred. The less compressible (less resilient, more rigid, etc.) portions in the longitudinal arch and medial heel areas (A and B in the drawing) may be the same or different in chemical composition and physical structure from the remaining portions of the insole member, and are preferably (but not necessarily) contiguous with each other (between the A and B portions and/or between those portions and the remaining more compressible portions, as shown in the drawing. The A and B portions may be more densed, contain smaller cells and/or thicker cell walls, and/or made of an entirely different less compressible material relative to the remaining portions of the insole member.

The insole member may be made in any suitable manner, as by injection molding (double injection, biphase single injection) vacuum or blow molding, etc. using suitable elastomeric material. The A and B portions may be bonded to each other and/or to the remaining portions of the insole member during the molding or other forming operation, or they may be separately made and then assembled by suitable bonding at their peripheries by means of heat and/or adhesive, etc., or without bonding on a sheet material (disposable or permanent).

The insole member of this invention provides a heretofore unattainable dynamic biomechanical system yielding multiple unexpected advantages in foot and gait control. This system permits the lateral column of the foot to depress in a piston-like action with each step, controls internal torque from the leg (in the first portion of the gait cycle), and redirects the torque of the leg in an external direction by allowing the lateral column of the foot to depress and invert (2nd portion of the gait cycle, slightly before midstance). The novel structure of this insole member for example (1) prevents excessive medial roll of the heel in the first portion of the gait cycle so as to function as a tri plane wedge, and (2) it forces the heel and lateral column of the foot to invert on full weight bearing (as approaching the midstance phase of the gait), thereby stabilizing the foot making it a rigid lever for the propulsive phase of the gait. It provides a piston-like action under weight bearing with each step so that there is a constant return to its original shape after weight-bearing has ceased. It provides a mechanical advantage to the subtalar joint toward supination so that lowering of the lateral column will occur more efficiently and sooner in the gait cycle. The foot therefore becomes a rigid lever at the time it is needed in the gait cycle when full body compression occurs. It limits excessive pronation in the initial portion of the gait cycle and prevents excessive excursion of the posterior calcaneal facet (heel acticulation) thereby preventing excessive migration of the talus (ankle bone) off the calcanaus (heel bone). Since the subtalar joint and the midtarsal joint can only move either clockwise or counter clockwise, the medial contact on the less compressible area will cause the heel to invert, causing the lateral column of the foot to depress and invert. This causes the midtarsal joint to move antagonistically to the supinating subtalar joint and pronate maximally thereby stabilizing the foot. The system allows the plantar fascia to act as a more efficient truss system in metatarsal plantar flexion and stability. It also allows the muscles to functionally contract at mechanical advantages for optimum foot mechanics.

The insole member of this invention is useful in all types of footwear, therapeutic or not, work or play, inactive or active, including for example all types of athletic shoes and boots, walking, jogging and running shoes, army boots, ski shoes, climbing boots, sneakers, slippers, etc.

The invention has been disclosed with respect to preferred embodiments, and various modifications and variations thereof obvious to those skilled in the art are to be included within the spirit and purview of this invention and the scope of the appended claims.

What is claimed is:

1. A footwear insole member comprising a first portion the upper surface of which approximately underlies a substantial portion the area of the longitudinal arch and a second portion the upper surface of which underlies at least about 10% of the medial area of the heel and where the second portion extends through substantially the whole of the medial heel, contiguously beyond from about 0% to about 50% of the lateral area of the heel, said first and second portions being contiguous with each other and being contiguous with and less compressible than the remaining portions of said member, the edges of said first and second portions adjacent to said remaining portions undercutting said remaining portions at a downwardly sloping angle of up to about 85° from the vertical to form a wedge which, at its heel end terminus, is entirely in the medial portion of the heel.

2. A member to claim 1 which comprises elastomeric material.

3. A member according to claim 2 wherein said material comprises a microcellular foam structure.

4. A member according to claim 3 wherein said structure is open-celled.

5. A member according to claim 3 wherein said structure is closed-celled.

6. A member according to claim 1 wherein said first and second portions are predominantly formed of material more dense than the material of the remaining portions of said member.

7. A member according to claim 1 wherein said undercutting edges horizontally comprise an approximately S-shaped configuration.

* * * * *